US011213126B2

(12) United States Patent
Artsiely

(10) Patent No.: US 11,213,126 B2
(45) Date of Patent: Jan. 4, 2022

(54) COUNTERTOP INSTALLATION

(71) Applicant: Caesarstone Ltd., Sdot Yam (IL)

(72) Inventor: Eyal Artsiely, Moshav Fazael (IL)

(73) Assignee: Caesarstone Ltd., Sdot Yam (IL)

( * ) Notice: Subject to any disclaimer, the term of this patent is extended or adjusted under 35 U.S.C. 154(b) by 0 days.

(21) Appl. No.: 16/666,423

(22) Filed: Oct. 29, 2019

(65) Prior Publication Data

US 2021/0120954 A1 Apr. 29, 2021

(51) Int. Cl.
*A47B 96/18* (2006.01)
*A47B 77/02* (2006.01)

(52) U.S. Cl.
CPC ..... *A47B 96/18* (2013.01); *A47B 77/022* (2013.01); *A47B 2077/025* (2013.01)

(58) Field of Classification Search
CPC .. A47B 96/18; A47B 77/022; A47B 2077/025
See application file for complete search history.

(56) References Cited

U.S. PATENT DOCUMENTS 3,101,486 A 8/1963 Tiller
5,743,501 A * 4/1998 Rapp ..... E03C 1/33 248/200.1
7,207,636 B2 * 4/2007 Livingston ..... A47B 47/0091 312/265.6
7,429,021 B2 * 9/2008 Sather ..... E03C 1/33 248/200.1
8,434,835 B2 5/2013 Hardy et al.
9,492,010 B2 * 11/2016 Booth ..... E03C 1/33
9,995,026 B2 * 6/2018 Booth ..... E03C 1/335
10,563,387 B1 2/2020 Iocco
2005/0073224 A1 * 4/2005 Livingston ..... A47B 47/0091 312/265.6
2008/0087778 A1 * 4/2008 Sather ..... E03C 1/33 248/201
2009/0134287 A1 5/2009 Klosowski
2012/0222213 A1 * 9/2012 Booth ..... E03C 1/18 4/648
2016/0097415 A1 * 4/2016 Jorgensen ..... F16B 12/04 156/293
2017/0037606 A1 * 2/2017 Booth ..... E03C 1/335
2018/0044901 A1 2/2018 Lloyd
2018/0180295 A1 6/2018 Kobos
2020/0229589 A1 7/2020 Hill

FOREIGN PATENT DOCUMENTS

DE 202017102734 U1 8/2018
DE 102019106949 A1 9/2020

* cited by examiner

*Primary Examiner* — Lawrence Averick
(74) *Attorney, Agent, or Firm* — The Roy Gross Law Firm, LLC; Roy Gross

(57) ABSTRACT

A method for countertop installation includes affixing a mechanical interface to at least one of a cabinet framework and a wall, and securing a countertop directly to the mechanical interface without directly attaching the countertop to the cabinet framework or the wall.

6 Claims, 7 Drawing Sheets

12

COUNTERTOP INSTALLATION

FIELD OF THE INVENTION

The present invention generally relates to a system and method for installation of countertops, such as stone countertops, and particularly in which the countertop can be easily removed and a new countertop installed in place of the previous one.

BACKGROUND OF THE INVENTION

A countertop usually refers to a horizontal surface in kitchens, furniture, bathrooms, or other table surfaces. It is frequently installed on and supported by a cabinet framework. The surface of a countertop is typically positioned at an optimal height for which the countertop is designed. The surface of a countertop may be constructed of various materials with different attributes and aesthetics. For example, countertop surfaces may be natural stone or artificial stone or other materials.

Traditional countertops, both natural and artificial, are often heavy, and require professional installers for installation. For instance, for natural materials, specialized equipment is required to cut, measure, and polish the materials, such as granite. In addition, granite slabs are exceptionally heavy, and require upright-vertical positioning when not supported horizontally to prevent the slabs from cracking or breaking. And typically, at least two people are required to transport, and install the slabs as countertops.

Laminate and similar countertops are heavy and awkward to maneuver. In addition, these countertops have other drawbacks. For instance, to fit and install these countertops requires special tools, and adhesives or other bonding agents. Sometimes the bonding agents emit noxious fumes, thereby requiring plenty of ventilation during the curing process. The overall process of installing laminate countertops is time consuming and labor intensive.

Another drawback is removal of a countertop for the installation of a new one is difficult; it usually involves breaking the countertop and can cause damage to the framework, wall or other kitchen items.

Another major problem in countertop installation is joining adjacent stone slabs without a visible seam. The two slabs ideally should abut against each other perfectly along the entire seam and should be at the same exact height so the user feels and sees the slabs as one continuous stone. In real life, however, nothing is perfect. The prior art requires a major effort to level the adjoining slabs and abut them; the slabs are heavy and cumbersome and it is a major challenge to level and adjoin them.

SUMMARY OF THE INVENTION

The present invention seeks to provide a novel and improved system and method for installation of countertops, such as stone countertops, and particularly in which the countertop can be easily removed and a new countertop installed in place of the previous one. In all embodiments, the countertop is not bonded to any framework or wall. In some embodiments, the countertop is affixed to a bracket such as with mechanical fasteners, but is not affixed to the framework, thereby enabling easy removal and replacement.

In one embodiment, there is a countertop levelling and adjoining system, which is affixed to the framework and provides an easy and convenient system for joining and levelling adjacent stone slabs without a visible seam. This is an elegant solution to the problem mentioned above, which in the prior art is a major challenge.

There is thus provided in accordance with a non-limiting embodiment of the present invention a method for countertop installation including affixing a mechanical interface to at least one of a cabinet framework and a wall, and securing a countertop directly to the mechanical interface without directly attaching the countertop to the cabinet framework or the wall.

The method may further include removing the countertop from the mechanical interface and installing in its place a different countertop.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS

It is noted that the terms horizontal, vertical, upper, lower and the like are relative to the drawings and are not limiting.

Figure 1B:
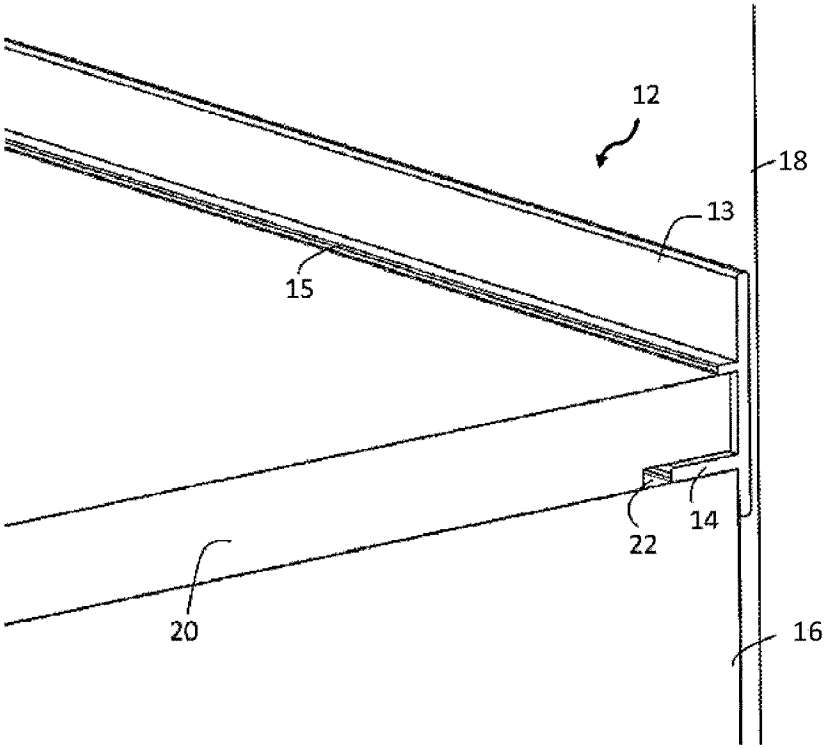
FIGS. 1A, 1B and 1C are simplified illustrations of a countertop installation system, in accordance with a non-limiting embodiment of the present invention, respectively showing installing a bracket member to a cabinet framework, installing the countertop to the bracket member and installing a wall piece to the wall above the countertop.
Figure 1A:
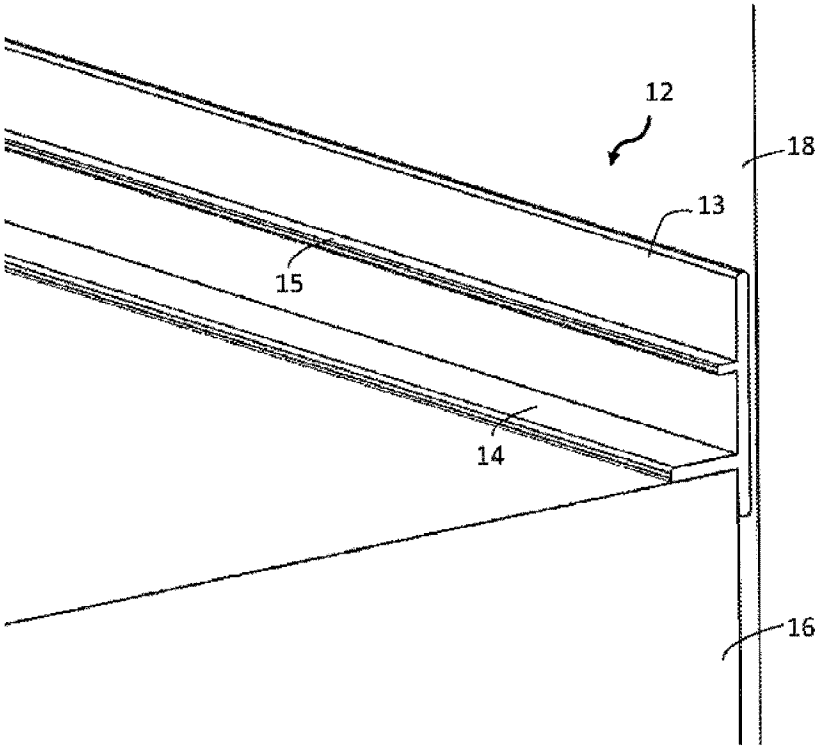
Figure 1C:
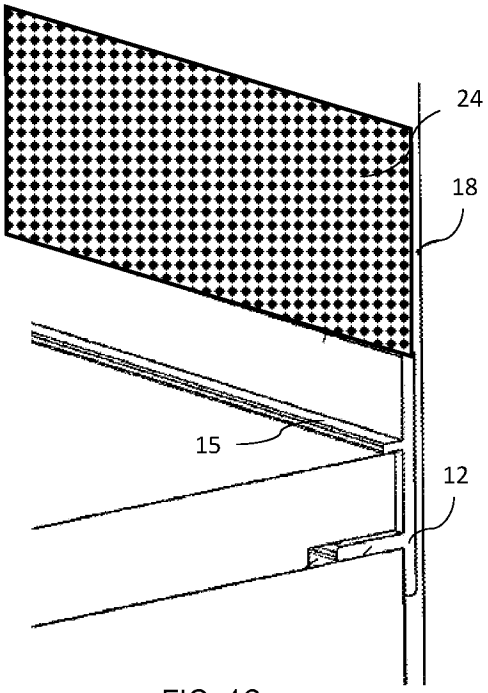

Reference is now made to FIGS. 1A, 1B and 1C, which illustrate a countertop installation system 10, in accordance with a non-limiting embodiment of the present invention.

System 10 may include a bracket member 12 which includes a wall interface member 13, a countertop support member 14 and a wall piece support member 15, both of which extend perpendicularly from wall interface member 13. The countertop support member 14 is spaced from (and is lower than) the wall piece support member 15. The countertop support member 14 may protrude further out from wall interface member 13 than the wall piece support member 15. The countertop support member 14 may not protrude from the end of wall interface member 13; instead a portion of wall interface member 13 may extend beyond (below) countertop support member 14.

In FIG. 1A, bracket member 12 is secured to a cabinet framework 16 and to a wall 18 (e.g., with fasteners such as screws). In FIG. 1B, a countertop 20 is installed on the bracket member 12. Countertop 20 may be natural such as granite, quartz, onyx, marble, sandstone, bluestone, limestone and other natural materials, or artificial, such as, concrete, laminate, acrylic or other manmade materials with various colors and patterns. Countertop 20 may be formed with an undercut surface 22 along its edge for the length of countertop support member 14. Thus, the undercut surface 22 rests on countertop support member 14. The space between countertop support member 14 and wall piece support member 15 is designed to accommodate the thickness of countertop 20. A non-adhesive sealant, such as RTV or other suitable material may be used to seal countertop 20 with respect to bracket member 12. In FIG. 1C, a wall piece 24 is installed to the wall 18 above the countertop 20, such as with RTV or other suitable material, as before. The wall piece 24 rests on wall piece support member 15.

Figure 2A:
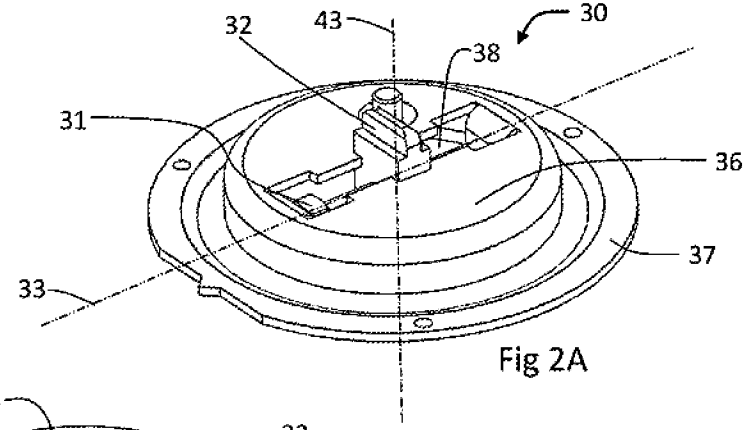
FIGS. 2A, 2B and 2C are simplified illustrations of a countertop installation system, in accordance with another non-limiting embodiment of the present invention, respectively showing top and bottom perspective views of a mechanical fastener for levelling and joining adjacent countertop portions in place and installation of the mechanical fastener with respect to the countertop.
Figure 2B:
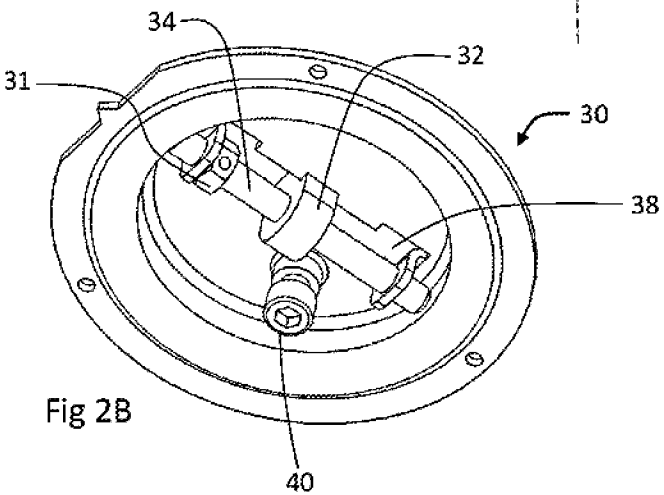
Figure 2C:
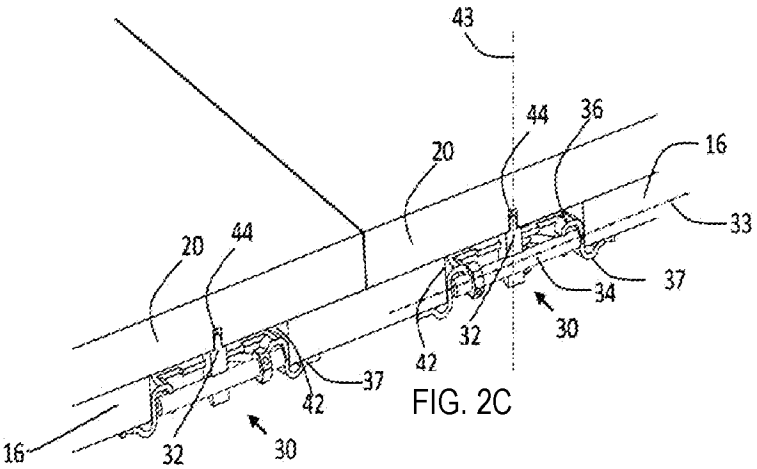

Reference is now made to FIGS. 2A, 2B and 2C, which illustrate a countertop installation system 30, in accordance with another non-limiting embodiment of the present invention. System 30 is useful for levelling and adjoining adjacent countertop portions.

The countertop installation system 30 may include a movable tongue 32 which is arranged to move along a first axis 33. For example, as seen in FIG. 2B, tongue 32 may be mounted on a threaded shaft 34 which is secured to an underside of a housing 36. The tongue 32 protrudes through a cutout 38 formed in housing 36. A rim 37 may extend outwards from housing 36. An adjustment screw 40 (FIG. 2B) may be provided, such as on the underside of housing 36. As seen in FIG. 2C, countertop installation system 30 may be installed in a hole 42 formed in the underside of framework 16. Housing 36 fits in the groove 42 and rim 37 is fastened to the underside of framework 16. Countertop 20 is formed with a slot 44 into which tongue 32 is received. Turning threaded shaft 34 adjusts the horizontal position of tongue 32 in slot 44, which adjusts the adjoining of neighboring countertop portions. In other words, the horizontal adjustment of tongue 32 against the underside of the countertop portion (in slot 44) is used to achieve a seamless adjoining of adjacent countertop portions.

Turning adjustment screw 40 pushes the end of the screw against the underside of the countertop portion and adjusts the vertical position of the countertop portion. In this manner, each adjacent countertop portion can be levelled easily by adjusting the height of screw 40 against the countertop portion and adjoined by adjusting the horizontal position of tongue 32 to achieve a seamless joint.

Figure 3A:
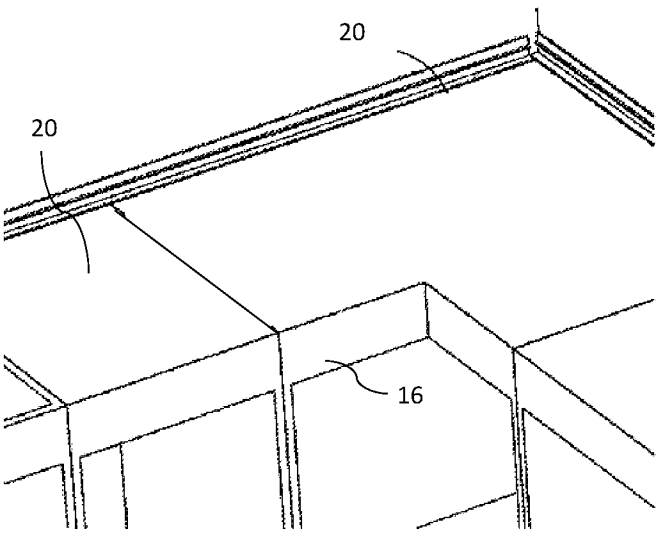
FIGS. 3A, 3B and 3C are simplified illustrations of installation of the countertop with the embodiment of FIGS. 2A-2C, respectively showing preparing holes in the framework to accept the mechanical fasteners, placing the countertop on the framework and a view from underneath the framework showing the placement of the mechanical fasteners which provide the levelling and adjoining of the adjacent countertop portions.
Figure 3C:
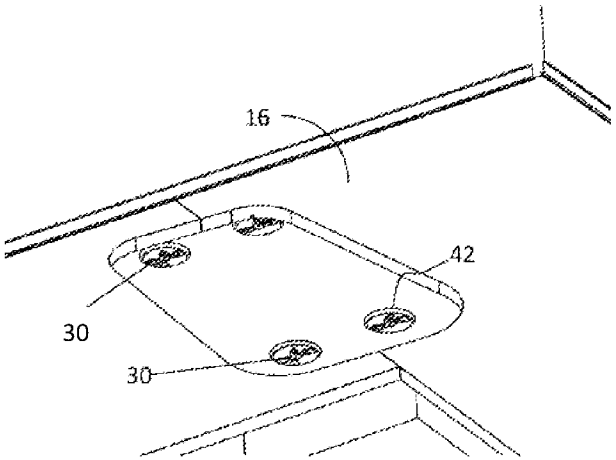
Figure 3B:
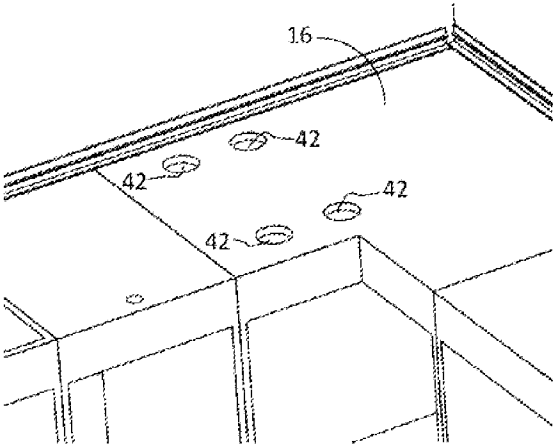

Reference is further made to FIGS. 3A, 3B and 3C, which are simplified illustrations of installation of the countertop 20 with the countertop installation system 30. In FIG. 3A, holes 42 are prepared in the framework 16 to accept the mechanical fasteners (the countertop installation systems 30). In FIG. 3B, the countertop 20 is placed on the framework 16. In FIG. 3C, as seen from underneath the framework 16, the countertop installation systems 30 have been placed in the holes 42. The installation system 30 is thus affixed to the framework and is easily accessible to achieve the seamless adjoining.

Figure 4C:
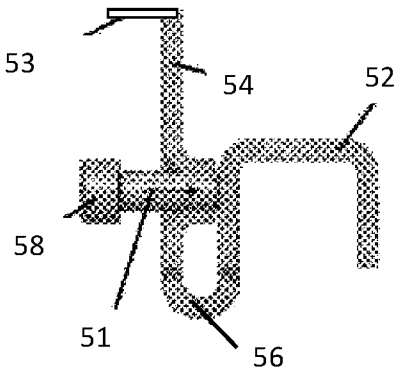
FIGS. 4A, 4B and 4C are simplified illustrations of a countertop installation system, in accordance with another non-limiting embodiment of the present invention, respectively showing a perspective view of a mechanical fastener for holding the countertop in place, a perspective view of the fastener and a side-view of the mechanical fastener showing how it tightens against the countertop.
Figure 4B:
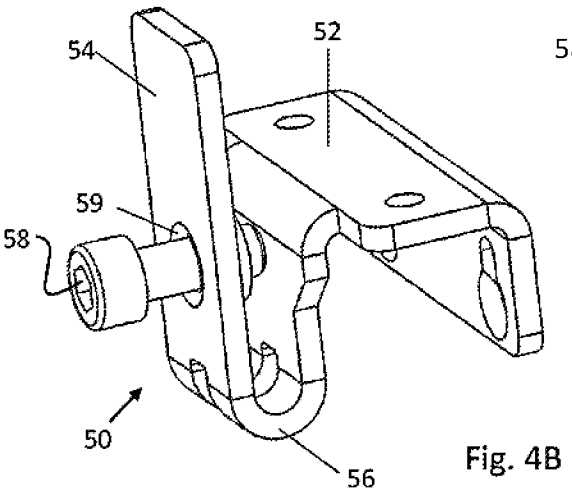
Figure 4A:
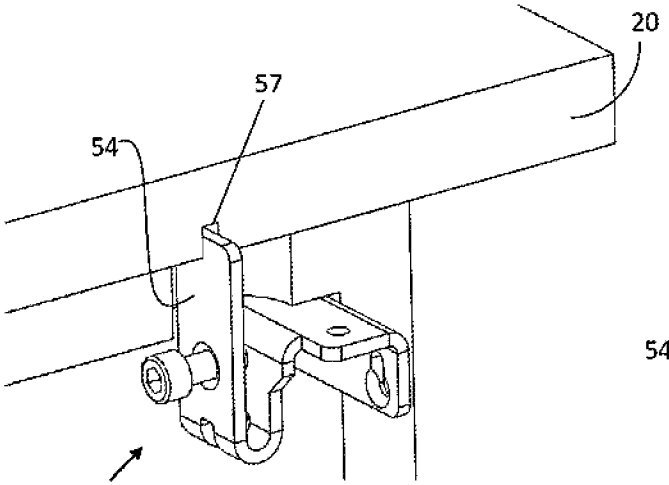

Reference is now made to FIGS. 4A, 4B and 4C, which illustrate a countertop installation system 50, in accordance with another non-limiting embodiment of the present invention.

As seen in FIGS. 4B and 4C, the countertop installation system 50 may include a framework bracket 52 and a countertop interface member 54 coupled to framework bracket 52 by a flexible member 56, such as a U-shaped resilient member. An adjustment screw 58 is coupled to countertop interface member 54, such as by threaded engagement with a threaded hole 59. The adjustment screw 58 can abut against a portion of framework bracket 52. Movement of adjustment screw 58 against framework bracket 52 (in the direction of an arrow 51) causes countertop interface member 54 to move further away from framework bracket 52 (in the direction of an arrow 53), as seen in FIG. 4C.

As seen in FIG. 4A, the countertop 20 is formed with a groove 57 into which is received countertop interface member 54. Tightening adjustment screw 58 against framework bracket 52 presses countertop interface member 54 against groove 57 and affixes countertop 20 in place. The fastener can be used for cabinets with or without horizontal support.

Figure 5:
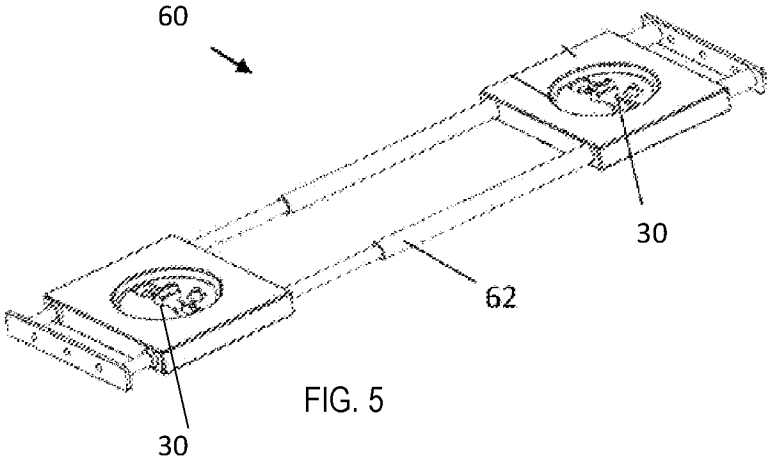
FIG. 5 is a simplified illustration of a telescoping frame for mounting the mechanical fasteners of FIGS. 2A-2C thereon, useful in cases where the framework or kitchen cabinets and the like do not have a horizontal top piece.

Reference is now made to FIG. 5. Sometimes, no horizontal cabinet framework is available to attach or mount the countertop installation systems. The invention provides a telescoping frame 60 for mounting the countertop installation system 30 of FIGS. 2A-2C thereon (or any other countertop installation system of the invention). The countertop installation system rests or slides on telescoping bars 62 which can be adjusted (that is, lengthen or shorten the overall length of the bars) to suit any installation requirement. Again, installation system 30 adjusts and adjoins neighboring countertop slabs.

Figure 6B:
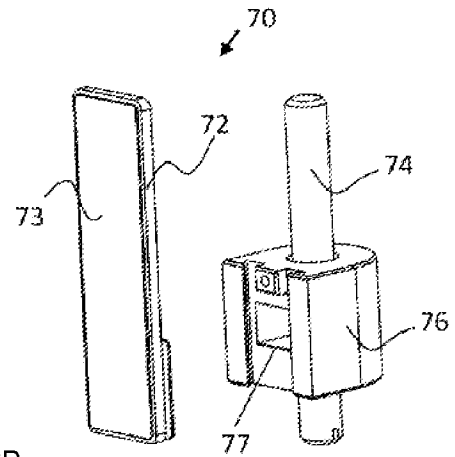
FIGS. 6A, 6B, 6C and 6D are simplified illustrations of a countertop installation system, in accordance with another non-limiting embodiment of the present invention, particularly useful for installation of a sink, respectively showing front and rear perspective views of a mechanical fastener for holding the countertop (sink) in place, a perspective view of the fasteners from underneath the countertop (sink), and a top perspective view showing the sink installed. These fasteners are useful for stainless steel sinks, which in the prior art are bonded to the countertop, which can cause damage if disassembly or removal is attempted.
Figure 6A:
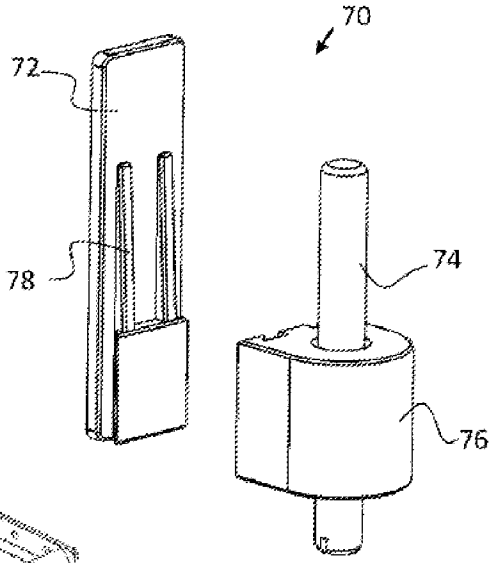
Figure 6D:
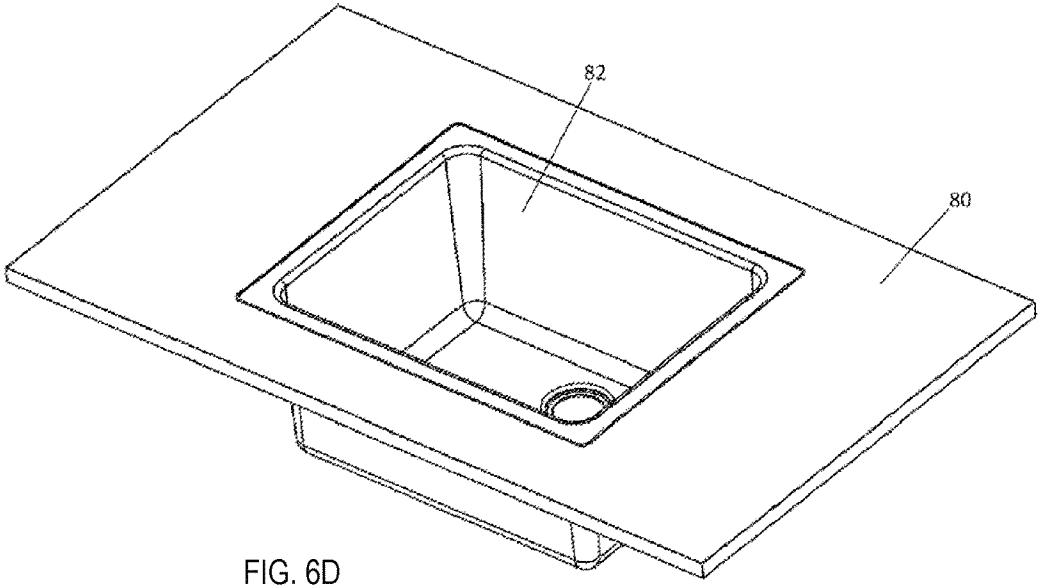
Figure 6C:
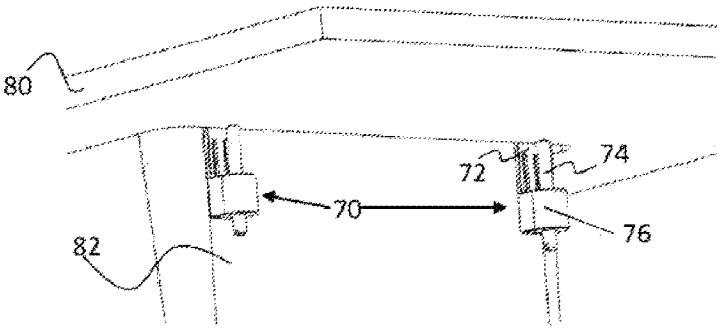

Reference is now made to FIGS. 6A, 6B and 6C, which illustrate a sink installation system 70.

As seen in FIGS. 6A and 6B, installation system 70 may include a sink wall mount member 72, which may be affixed to a wall of a sink 82 such as by means of an adhesive backing 73. Installation system 70 may include a pusher element 74, such as a threaded rod that is arranged to move linearly in a threaded housing 76. Housing 76 may include a mating element 77 that mates with a receiving element 78 on wall mount member 72.

FIG. 6C illustrates installation system 70 mounted on the wall of sink 82 underneath a countertop 80. The sink wall mount member 72 is mounted to the wall of sink 82. The mating element of housing 76 is received in receiving element 78 of sink wall mount member 72. The pusher element 74 can be moved so that it abuts against the underside of countertop 80. As seen in FIG. 6D, a rim of sink 82 rests upon countertop 80. The pusher element 74 presses the underside of countertop 80 against this rim to secure sink 82 in place.

What is claimed is:

1. A method for countertop installation comprising:

affixing a mechanical interface to at least one of a cabinet framework and a wall; and securing a countertop directly to said mechanical interface without directly attaching said countertop to said cabinet framework or said wall, wherein said mechanical interface comprises a bracket member which comprises a wall interface member, a countertop support member and a wall piece support member, both of which extend perpendicularly from said wall interface member, and wherein a portion of said wall interface member extends beyond said countertop support member.

2. The method according to claim 1, further comprising removing said countertop from said mechanical interface and installing in its place a different countertop.

3. The method according to claim 1, wherein said countertop support member is spaced from said wall piece support member.

4. The method according to claim 1, wherein said countertop support member protrudes further out from said wall interface member than said wall piece support member.

5. The method according to claim 1, wherein said mechanical interface comprises a framework bracket and a countertop interface member coupled to said framework bracket by a flexible member, and an adjustment screw coupled to said countertop interface member, wherein movement of said adjustment screw against said framework bracket causes said countertop interface member to move further away from said framework bracket, and said countertop is formed with a groove into which is received said countertop interface member, and wherein tightening said adjustment screw against said framework bracket presses said countertop interface member against said groove and affixes said countertop in place.

6. A method for countertop installation comprising:

affixing a mechanical interface to at least one of a cabinet framework and a wall; and securing a countertop directly to said mechanical interface without directly attaching said countertop to said cabinet framework or said wall, wherein said mechanical interface comprises a framework bracket and a countertop interface member coupled to said framework bracket by a flexible member, and an adjustment screw coupled to said countertop interface member, wherein movement of said adjustment screw against said framework bracket causes said countertop interface member to move further away from said framework bracket, and said countertop is formed with a groove into which is received said countertop interface member, and wherein tightening said adjustment screw against said framework bracket presses said countertop interface member against said groove and affixes said countertop in place.

* * * * *